United States Patent [19]

Weiss

[11] Patent Number: 4,638,905

[45] Date of Patent: Jan. 27, 1987

[54] INCLINED GRATE FOR FURNACES

[75] Inventor: Manfred Weiss, Lauda-Königshofen, Fed. Rep. of Germany

[73] Assignee: Richard Kablitz GmbH & Co. KG, Fed. Rep. of Germany

[21] Appl. No.: 645,669

[22] Filed: Aug. 30, 1984

[30] Foreign Application Priority Data

Aug. 30, 1983 [DE] Fed. Rep. of Germany ..... 3331156

[51] Int. Cl.[4] ..... B65G 25/00

[52] U.S. Cl. ..... 198/774; 414/156; 110/281; 110/328; 126/152 B; 432/134

[58] Field of Search ..... 198/773, 774; 34/164; 110/278, 281, 289, 291, 328; 126/152 A, 152 R, 152 B, 163 R; 432/134; 414/156

[56] References Cited

U.S. PATENT DOCUMENTS

| | | | |
|---|---|---|---|
| 2,794,531 | 6/1957 | Stelzer | 198/321 |
| 4,563,959 | 1/1986 | Fujiwara | 414/156 X |
| 4,569,437 | 2/1986 | Doerges | 110/281 X |

FOREIGN PATENT DOCUMENTS

| | | | |
|---|---|---|---|
| 97722 | 1/1964 | Denmark | 110/281 |
| 461055 | 6/1928 | Fed. Rep. of Germany | 110/281 |
| 509698 | 5/1939 | Fed. Rep. of Germany | 110/281 |
| 970380 | 9/1958 | Fed. Rep. of Germany | 34/164 |

*Primary Examiner*—Joseph E. Valenza
*Assistant Examiner*—Jonathan D. Holmes
*Attorney, Agent, or Firm*—Wigman & Cohen

[57] ABSTRACT

A furnace grate structure for a furnace or incinerator on which solid fuel advances in an advancing direction has at least two parallel grate beams extending substantially transversely to the advancing direction, the beams being mounted on a substructure and forming upwardly facing support surfaces. A bank of elongated grate bars which extend substantially parallel to the advancing direction are supported on the upwardly facing support surfaces, and are spaced from each other. Each of the grate beams comprises a plurality of sections arranged end to end so that the length of the grate beams can be varied simply by changing the number of sections.

12 Claims, 5 Drawing Figures

INCLINED GRATE FOR FURNACES

BACKGROUND OF THE INVENTION

The invention relates to an inclined grate for furnaces having grate beams mounted on a furnace substructure laterally to the conveyance direction of the fuel. The ends of grate bars are mounted on the beams. The grate bars lie parallel to the conveyance direction of the fuel and are spaced from one another.

Inclined grates of this type have been known for a long time and are particularly suited to optimize the use of fuels having low combustion values and combustible by-products. By means of the fact that several rows of grate bars can be arranged one behind the other like steps, thereby subdividing the grate into sections, a particularly good and adaptable stirring effect is achieved when some of the grate bars are moved back and forth in an essentially horizontal direction. By regulating the grate movement in the individual grate sections, inclined grates of this type can be adapted to the characteristics of various fuels.

Because of the high thermal loads to which such inclined grates are subjected, the grate beams serve primarily as a framework to support the grate bars which are made of steel and cannot withstand the thermal loads. For this reason, the grate beams generally consist of a grey cast iron that can withstand the thermal loads.

In the known inclined grates of this type the grate beam extends over the entire width of the inclined grate. If the width of an inclined grate ever deviates from the normal width, then special grate beams must be manufactured for such an inclined grate which is expensive because of the relatively large costs for the molds necessary therefore.

OBJECTS AND SUMMARY OF THE INVENTION

The object of the invention is to create an inclined grate for furnaces of the above-described type, in which while using the same molds, grate beams of various lengths can be manufactured for inclined grates of different lengths.

This object is achieved with an inclined grate of the above-described type according to the invention, in that at least one grate beam has at least two identical grate beam sections, which form the grate beam by being arranged in a straight line with abutting ends.

The invention makes it possible to make at least one or even all of the grate beams from two or more grate beam sections. Thus, the joining of identical grate beam sections makes it possible to produce various lengths of grate beams.

In a particularly advantageous embodiment of the invention, it is provided that each grate beam section has a length such as to only allow for the mounting of two grate bars. One grate bar can be moved in a reciprocating manner essentially horizontally and the other grate bar is rigidly mounted on the grate beam section. This produces a very small grate bar element from which, for the grate bars of a given width, all possible widths of inclined grates can be manufactured. Each grate beam section, together with the two grate bars that can be mounted thereon, form the smallest possible unit of an inclined grate, so that the invention makes possible an optimal variation of grate widths for given grate bars.

By means of the fact that one bar can be reciprocated in an essentially horizontal direction and the other grate bar is rigidly mounted on the grate beam section, an alignment of any desired number of grate bar sections results in the creation of a grate in which every other grate bar can be reciprocated horizontally.

Additionally, characteristics of the invention are explained in greater detail in the following description of an exemplary embodiment illustrated in the drawings.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
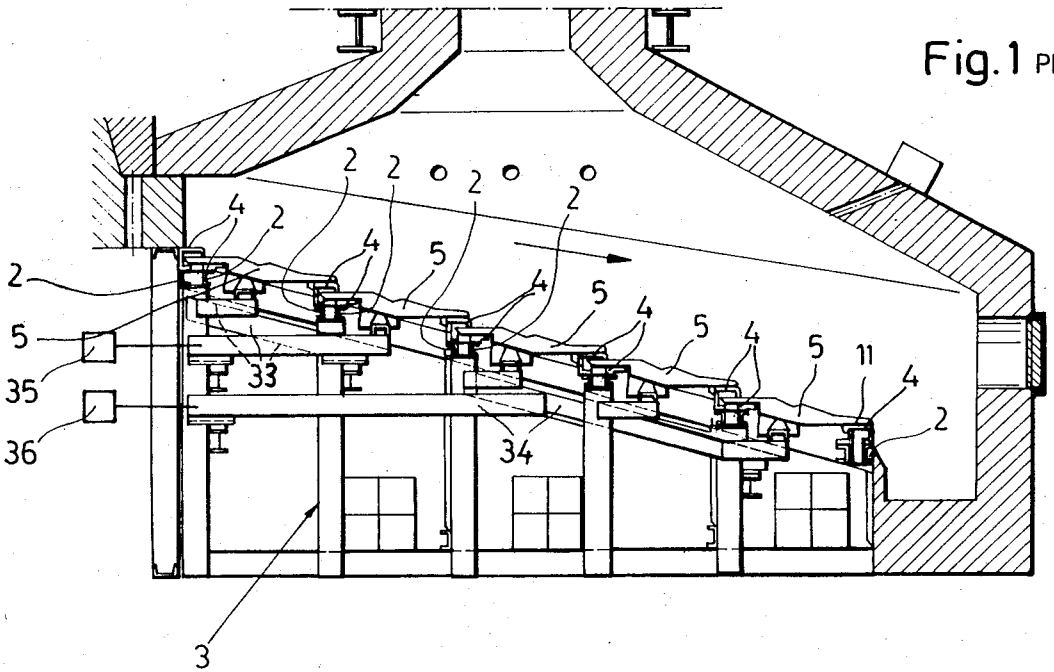
Fig. 1 PRIOR ART
FIG. 1 is a side view in partial cross-section of a furnace with a conventional inclined grate.
Figure 2:
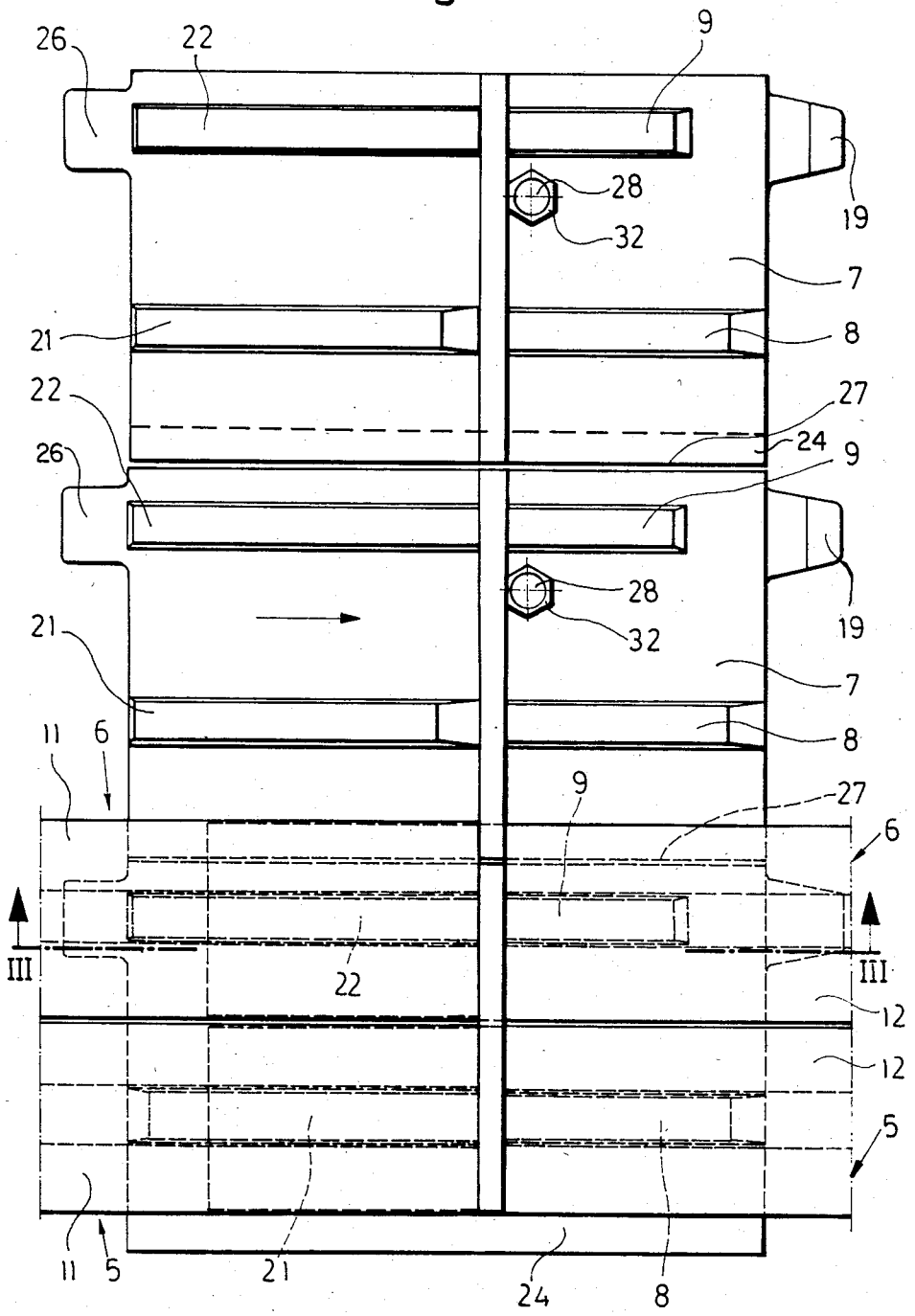
FIG. 2 is a top view of a center portion of a grate beam consisting of three grate beam sections, in which only the ends of the two pairs of grate bars mounted on one grate beam section are illustrated.

The known inclined grate illustrated in FIG. 1, which is arranged in a furnace shown in section, includes a furnace substructure 3, having support rails 2 arranged in pairs. A grate beam 4 is mounted on each pair of support rails 2 and extends essentially horizontally and perpendicularly to the conveyance direction of the fuel, which is indicated in FIGS. 1 and 2 by an arrow. The ends 11 and 12 of the grate bars 5 and 6 are mounted on the grate beams 4.

Figure 3:
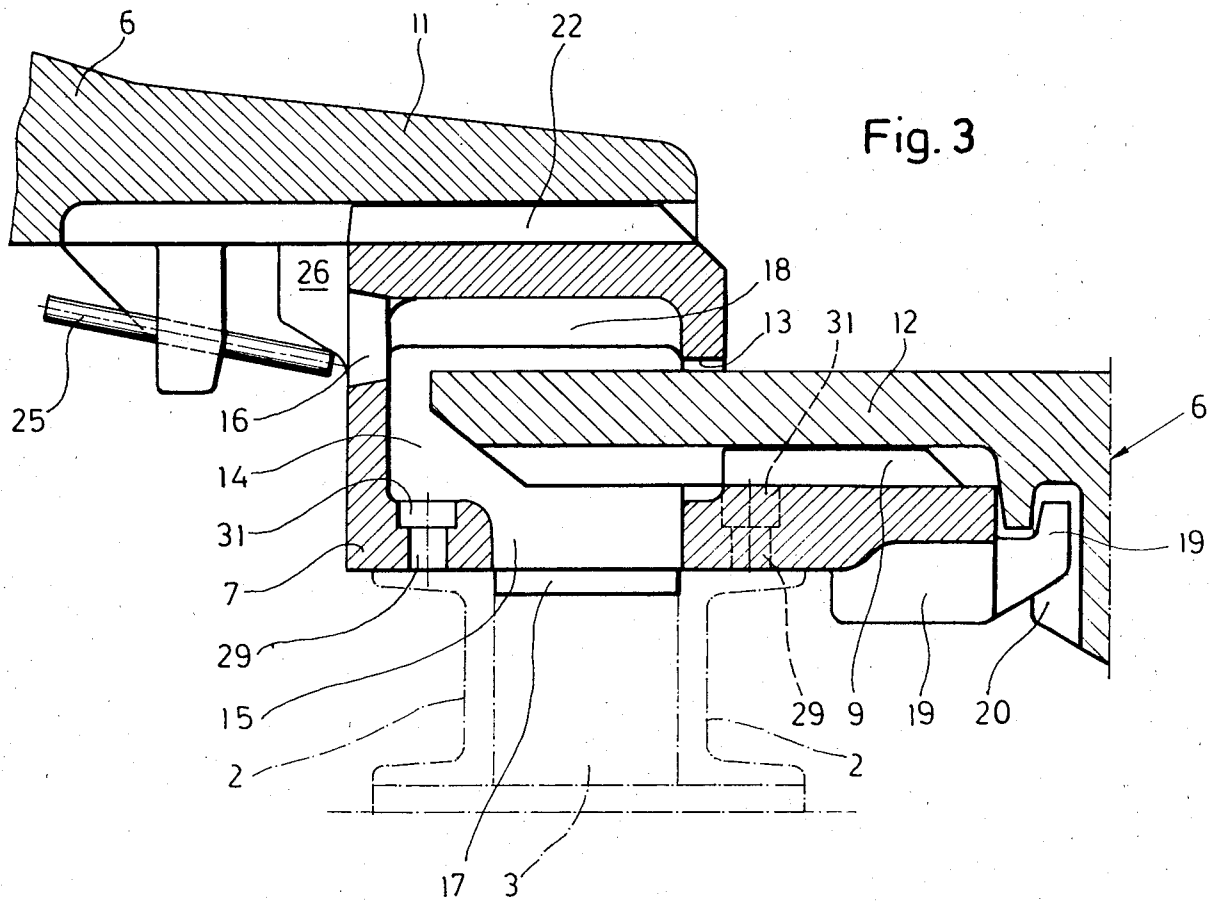
FIG. 3 is a cross-section along the line III—III in FIG. 2.
Figure 5:
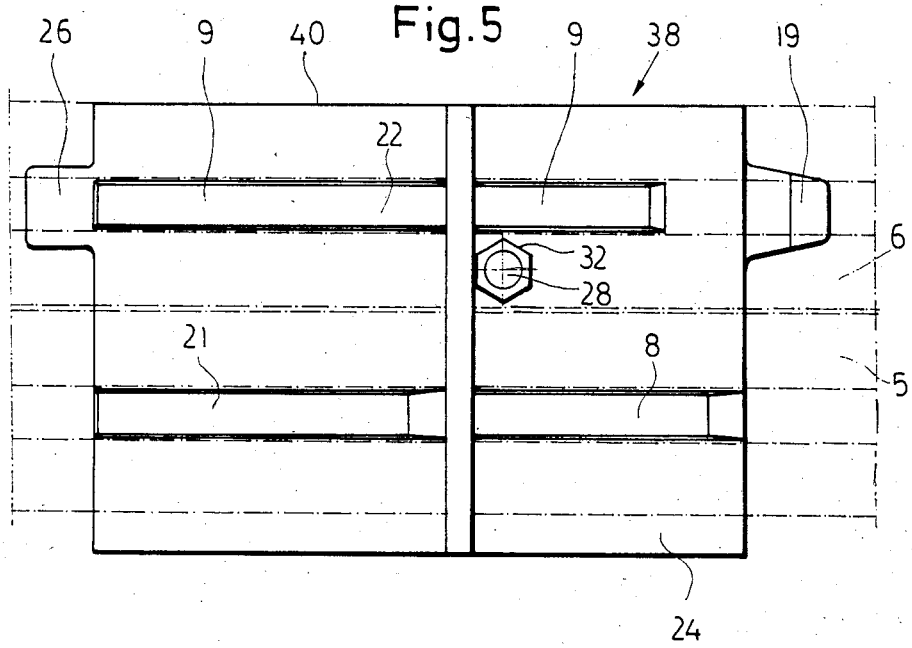
FIGS. 4 and 5 are illustrations corresponding to FIG. 2 showing a right and left end section, respectively, of the grate beam with the grate bars shown with broken lines.

As can be seen from FIG. 2, the center portion of the grate beam in the exemplary embodiment illustrated in FIGS. 2 and 3, comprises three grate beam sections 7, which are arranged in a straight line with respective ends thereof being directed toward each other. The two end sections 37 and 38, illustrated in FIGS. 4 and 5, together with beam section 7, form the entire grate beam 4.

Each grate beam section 7 has a pair of guide and holding ribs 8 and 9 for the higher-lying ends 12 of two grate bars 5 and 6 lying downstream in the direction of conveyance. The grate bar 6, as can be seen from FIG. 3, is rigidly connected with the grate beam section 7. For this purpose, the higher end 12 of the rigid grate bar 6, which is directed against the direction of conveyance, passes through an opening 13, which is provided for the ends 12 of both grate bars 5 and 6, and into a hollow chamber 14 in the grate beam section 7. The hollow chamber 14 is connected with the outside air for ventilation by a bottom space 15 and a rear space 16, whereby exterior and interior cooling ribs 17 and 18, respectively, are provided between the spaces 15 and 16 to cool the grate bar section.

To lock the rigid grate bars 6 into place with the grate beam sections 7, hook-like projections 19 are provided on said grate beam sections 7, which engage with corresponding recesses 20 in the rigid grate bars 6.

Guide and holding ribs 21 and 22 for the lower-lying ends 11 of the movable and rigid grate bars 5 and 6, respectively, which align with the guide and holding ribs 8 and 9 and lie downstream in the direction of conveyance, are provided on the upper side of the grate beam sections 7. The rigid grate bars 6 are hereby locked into place by means of a pin 25, which engages under a nub 26 on the grate beam sections 7, in such a manner that the ends of the rigid grate bars 6 supported on the upper side of the grate beam sections 7 cannot be lifted away from the grate beam sections 7. See FIG. 3. If, in the illustrated example, the three grate beam sections 7 together with the end sections 37 and 38 are arranged in a row with their ends abutting one another to form a grate beam 4 on support rails 2, then the grate bars 5 and 6 supported on this grate beam 4 form two successive rows, as viewed in the direction of conveyance, having alternating movable and rigid grate bars 5 and 6.

The movable grate bars 5 are connected in a known manner with the immediately adjacent rigid grate bars 6 in such a manner that they can be moved in an essentially horizontal direction, but cannot be lifted away. For this purpose both sides of the rigid grate bars 6 are provided with projections (not illustrated in the drawings), which engage in corresponding lateral recesses in the movable grate bars 5, which recesses also extend essentially horizontally and are also not illustrated.

As can be seen from FIG. 2, the guide and holding rib pairs 8 and 9 as well as 21 and 22 are disposed above the vertical center plane of each of the grate beam sections 7 lying parallel to the longitudinal axes of the grate bars 5 and 6 in such a manner that a mounting strip 24 remains free at the lower end of each grate beam section, above which the upper edges of the respective rigid grate bars 6 project, as shown in FIG. 2, so that in this manner the spaces or joints 27 present between the grate beam sections 7 are covered by the rigid grate bars 6. This prevents burning fuel from falling through those spaces onto the support rails 2.

For the two rows of grate bars 5 and 6 in the illustrated exemplary embodiment, mounted on a five-member grate beam shown at the left in FIG. 1, one drive 35 (shown only schematically in the drawing) is provided for all of the movable grate bars 5 in common, and a drive 36 is provided for the movable grate bars 5 of the three following rows of grate bars 5 and 6, which drive 36 causes the movable grate bars 5 to reciprocate horizontally. A more detailed illustration and description of the frames 33 and 34, which connect these drives with the movable grate bars 5, is unnecessary, because they correspond to the prior art relative to one-piece grate means and do not form the object of the invention.

Each grate beam section 7, 37 and 38 is connected with its support rails 2 by four screws 28. The screws 28 are only illustrated in FIG. 2. FIG. 3 shows two bores 29 for these screws 28, which bores are provided at their upper ends with a six-sided expanded area 31, into which a nut 32 can be placed for the screws 28.

As can be seen particularly from FIG. 2, grate beams 4 can be assembled in any desired length from the grate beam sections 7. One therefore need have only three molds for furnaces of any size and of varying widths to manufacture the grate beam sections 7 and the two end sections 37 and 38, because all of the grate beam sections 7 of a grate beam are completely identical.

Figure 4:
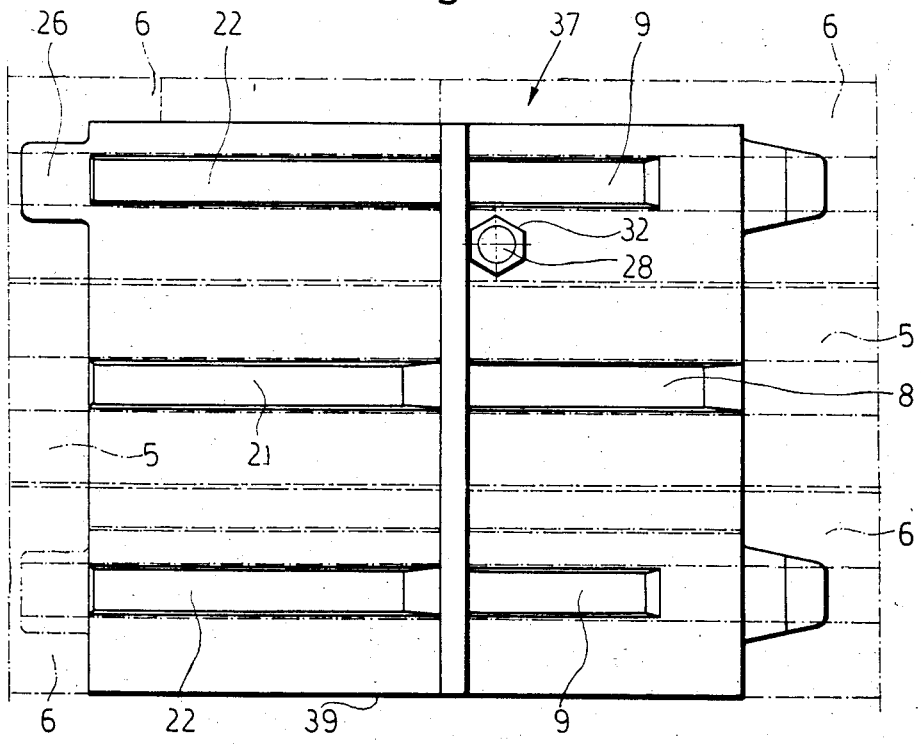

The right end section 37, as viewed in the direction of conveyance is illustrated in FIG. 4. It differs from the center grate beam sections 7 illustrated in FIGS. 2 and 3 only in that it extends so far to the right that an additional right rigid grate bar 6 can be mounted thereon in such a manner that the right side surface of the grate bar 6 aligns with the right frontal surface 39 of the end section 37, i.e., without a mounting strip corresponding to the mounting strip 24 remaining free.

The left end section 38, as viewed in the direction of conveyance, differs from the center grate bar sections 7 only in that its left end extends so far to the left that it extends over the entire width of the left outside rigid grate bar 6, so that its left side surface aligns with the left frontal surface 40. Each grate bar row is thus limited at its two sides by a stationay grate bar 6, which abuts the adjacent side wall of the furnace chamber.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A furnace grate structure over which solid fuel advances in a direction of conveyance as said fuel is combusted, said grate structure comprising:

a plurality of grate beams extending substantially parallel to one another and substantially transversely to said direction of conveyance and supported on a substructure, said beams forming upwardly facing support surfaces;

at least one bank of first and second types of elongated grate bars which extend substantially parallel to said direction of conveyance in spaced relation to each other, said grate bars having upwardly facing support surfaces inclined downwardly in said direction of conveyance for conveying said solid fuel, each of said grate bars being supported at each end thereof on a mounting surface of a respective said grate beam such that said first type of grate bars are reciprocatingly movable in a substantially horizontal direction and said second type of grate bars are stationary, said bank of said grate bars being defined by alternating ones of said first and said second types of grate bars lying parallel and adjacent to one another;

at least one of said grate beams comprises a plurality of grate beam sections, each beam section having two ends, said grate beam sections being arranged end to end on said substructure to form one of said grate beams having gaps between adjacent grate beam sections; and keyed engagement means on said grate beam sections for guiding and laterally positioning said reciprocatingly movable and said stationary grate bars such that each of said gaps between said adjacent ends of said grate beam sections are covered by a respective one of said grate bars.

2. The furnace grate structure according to claim 1, wherein said grate bar which extends over the gaps between said adjacent ends of said grate beam sections is a stationary grate bar.

3. The furnace grate structure according to claim 1, comprising a first and a second bank of said grate bars arranged successively in said fuel advancing direction, wherein said grate beam sections have upper mounting surfaces for said lower end portions of said grate bars of said first bank and a lower mounting surface for said upper end portions of said grate bars of said second grate beam bank.

4. The furnace grate structure according to claim 1, wherein said grate beam sections support two grate bars, one of said two grate bars being reciprocatingly movable parallel to said direction of conveyance and the other being stationary.

5. The furnace grate structure according to claim 1, wherein at least two of said grate beam sections are identical.

6. The furnace grate structure according to claim 1, wherein said at least one bank of said grate bars has two outside grate bars, said two outside grate bars being stationary.

7. The furnace grate structure according to claim 6, wherein said grate beam sections are located between special end sections for supporting said outside grate bars, said special end sections having an inner end surface abutting one of said end surfaces of the adjacent of said grate beam sections and an outer surface, said outer surface being aligned with the adjacent of said side surfaces of said outside grate bar.

8. The furnace grate structure according to claim 7, wherein all said grate beam sections located between said special end sections are identical.

9. The furnace grate structure according to claim 1, wherein said grate beam sections comprise a hollow space which is connected to the outside by lower and upper apertures for creating a ventilation stream.

10. The furnace grate structure according to claim 9, wherein said grate beam sections have cooling ribs which are located in said ventilation stream.

11. The furnace grate structure according to claim 1, further comprising a common drive for said reciprocatingly movable grate bars.

12. The furnace grate structure of claim 1 wherein:

said grate bars have two opposite longitudinal side surfaces extending along said grate bars; and one of said two opposite longitudinal side surfaces of said grate bar of said second type is supported adjacent to one end of one of said grate beam sections and extends over said end of said beam section, and said support surface adjacent to the other end of said grate beam sections extends beyond the other of said two opposite longitudinal side surfaces of a grate bar of said first type supported on said grate beam section adjacent to said other end of said grate beam section, so that joints between said ends of said grate beam sections are covered by a grate bar of said second type.

* * * * *